US011450260B2

(12) United States Patent
Park et al.

(10) Patent No.: US 11,450,260 B2
(45) Date of Patent: Sep. 20, 2022

(54) DISPLAY DEVICE AND DRIVING METHOD THEREOF

(71) Applicant: SAMSUNG DISPLAY CO., LTD., Yongin-si (KR)

(72) Inventors: Hee Sook Park, Yongin-si (KR); Kyoung Ho Lim, Yongin-si (KR); Seung Ho Park, Yongin-si (KR); Jae Hoon Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/479,306

(22) Filed: Sep. 20, 2021

(65) Prior Publication Data

US 2022/0198998 A1 Jun. 23, 2022

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2320/0257* (2013.01); *G09G 2320/0666* (2013.01); *G09G 2320/103* (2013.01); *G09G 2330/021* (2013.01)

(58) Field of Classification Search
None
See application file for complete search history.

(56) References Cited

U.S. PATENT DOCUMENTS 6,794,824 B2 9/2004 Song et al.
7,352,352 B2 4/2008 Oh et al.
8,155,499 B2 4/2012 Im
9,153,161 B1 10/2015 Byun
10,127,857 B2 11/2018 Lee et al.
10,510,292 B2 12/2019 Jang
2011/0298818 A1* 12/2011 Mori ..... G09G 3/3208 345/589
2016/0140905 A1* 5/2016 Yoo ..... G09G 3/3233 345/82
2021/0327332 A1* 10/2021 Choi ..... G09G 3/32
2021/0335273 A1* 10/2021 Meng ..... G09G 3/3208

FOREIGN PATENT DOCUMENTS

KR 100467449 B1 1/2005
KR 100497344 B1 6/2005
KR 100745249 B1 7/2007
KR 100989159 B1 10/2010
KR 101330215 B1 11/2013
KR 1020170087559 A 7/2017
KR 1020180047072 A 5/2018
KR 1020190032807 A 3/2019
KR 102123585 B1 6/2020

* cited by examiner

*Primary Examiner* — Dorothy Harris
(74) *Attorney, Agent, or Firm* — Cantor Colburn LLP

(57) ABSTRACT

A display device includes a set period setting unit for setting, as a set time, a time for which a set period elapses from a time at which a first area included in an input image is detected as a still area, and a gain generator for gradually decreasing an initial level of a gain value down to a saturation level having a lowest value of the gain value from the set time. The set period setting unit differently sets the saturation level of the gain value and a final level of the gain value, corresponding to grayscale values of the first area and a load value of the input image. The load value is an average value of grayscale values of an entirety of an area of the input image.

20 Claims, 16 Drawing Sheets

DISPLAY DEVICE AND DRIVING METHOD THEREOF

The application claims priority to Korean patent application 10-2020-0180057 filed on Dec. 21, 2020, and all the benefits accruing therefrom under 35 U.S.C. § 119, the content of which in its entirety is herein incorporated by reference.

BACKGROUND

1. Field

Embodiments of the invention generally relate to a display device and a driving method thereof, and more particularly, to a display device for reducing power consumption and a driving method of the display device.

2. Description of the Related Art

With a development of information technologies, an importance of a display device which is a connection medium between a user and information increases. Accordingly, display devices such as a liquid crystal display device and an organic light emitting display device are increasingly used.

A display device may include a plurality of pixels, and display a frame through a combination of lights emitted from the pixels. When a plurality of frames is sequentially displayed, a user may recognize the plurality of frames as an image (moving image or still image).

When a still image is displayed, an afterimage may be prevented and power consumption may be reduced, by a screensaver function of lowering luminance of the image.

SUMMARY

When a time at which a display device enters into a screensaver is constant regardless of a load of a display panel, a lifetime of a pixel is decreased. Therefore, degradation of a panel occurs, and power consumption is increased.

Embodiments provide a display device and a driving method thereof, which may change a time at which the display device enters into a screen saver by a histogram and a load value of an input image.

Embodiments also provide a display device and a driving method thereof, which may change a gain value of a screensaver by a histogram and a load value of an input image.

In an embodiment of the invention, there is provided a display device including a set period setting unit which sets, as a set time, a time for which a set period elapses from a time at which a first area included in an input image is detected as a still area, and a gain generator which gradually decreases an initial level of a gain value down to a saturation level having a lowest value of the gain value from the set time, wherein the set period setting unit differently sets the saturation level of the gain value and a final level of the gain value, corresponding to grayscale values of the first area and a load value of the input image, and wherein the load value is an average value of grayscale values of the entire area of the input image.

In an embodiment, the gain generator may increase the gain value up to the final level, after a predetermined period elapses from a time at which the gain value reaches the saturation level.

In an embodiment, the set period setting unit may calculate histogram values of pixels constituting the first area by the grayscale values of the first area, and calculate the histogram value of a pixel having a largest grayscale value among the pixels.

In an embodiment, the set period setting unit may set the set period to become shorter as the histogram value becomes larger, and set the set period to become longer as the histogram value becomes smaller.

In an embodiment, the gain generator may set the final level of the gain value to become smaller as the histogram value becomes larger, and set the final level of the gain value to become larger as the histogram value becomes smaller.

In an embodiment, the gain generator may set the saturation level of the gain value to become larger as the histogram value becomes larger, and set the saturation level of the gain value to become smaller as the histogram value becomes smaller.

In an embodiment, the set period setting unit may set the set period to become longer as the load value of the input image becomes larger, and set the set period to become shorter as the load value of the input image becomes smaller.

In an embodiment, the gain generator may set the final level of the gain value to become larger as the load value becomes larger, and set the final level of the gain value to become smaller as the load value becomes smaller.

In an embodiment, the gain generator may set the saturation level of the gain value to become smaller as the load value becomes larger, and set the saturation level of the gain value to become larger as the load value becomes smaller.

In an embodiment, the display device may further include a still area detector which detects the first area of the input image as the still area, and provide the grayscale values of the first area, and a load calculator which calculates, as the load value, an average value of the grayscale values of the entire area of the input image.

In an embodiment of the invention, there is provided a method for driving a display device including a set period setting unit and a gain generator, the method including setting, by the set period setting unit, as a set time, a time for which a set period elapses from a time at which a first area included in an input image is detected as a still area, and gradually decreasing, by the gain generator, an initial level of a gain value down to a saturation level having a lowest value of the gain value from the set time, wherein the set period setting unit differently set the saturation level of the gain value and a final level of the gain value, corresponding to grayscale values of the first area and a load value of the input image, and wherein the load value is an average value of grayscale values of the entire area of the input image.

In an embodiment, the gradually decreasing the initial level of the gain value down to the saturation level of the gain value may include increasing, by the gain generator, the gain value up to the final level, after a predetermined period elapses from a time at which the gain value reaches the saturation level.

In an embodiment, the setting, as a set time, the time for which the set period elapses from the time at which the first area included in the input image is detected as the still area may include calculating, by the set period setting unit, histogram values of pixels constituting the first area by the grayscale values of the first area, and calculating, by the set period setting unit, the histogram value of a pixel having a largest grayscale value among the pixels.

In an embodiment, the setting, as a set time, the time for which the set period elapses from the time at which the first area included in the input image is detected as the still area may include setting, by the set period setting unit, the set period to become shorter as the histogram value becomes larger, and setting, by the set period setting unit, the set period to become longer as the histogram value becomes smaller.

In an embodiment, the gradually decreasing the initial level of the gain value down to the saturation level of the gain value may include setting, by the gain generator, the final level of the gain value to become smaller as the histogram value becomes larger, and setting, by the gain generator, the final level of the gain value to become larger as the histogram value becomes smaller.

In an embodiment, the gradually decreasing the initial level of the gain value down to the saturation level of the gain value may include setting, by the gain generator, the saturation level of the gain value to become larger as the histogram value becomes larger, and setting, by the gain generator, the saturation level of the gain value to become smaller as the histogram value becomes smaller.

In an embodiment, the setting, as a set time, the time for which the set period elapses from the time at which the first area included in the input image is detected as the still area may include setting, by the set period setting unit, the set period to become longer as the load value of the input image becomes larger, and setting, by the set period setting unit, the set period to become shorter as the load value of the input image becomes smaller.

In an embodiment, the gradually decreasing the initial level of the gain value down to the saturation level of the gain value may include setting, by the gain generator, the final level of the gain value to become larger as the load value becomes larger, and setting, by the gain generator, the final level of the gain value to become smaller as the load value becomes smaller.

In an embodiment, the gradually decreasing the initial level of the gain value down to the saturation level of the gain value may include setting, by the gain generator, a middle level of the gain value to become smaller as the load value becomes larger, and setting, by the gain generator, the middle level of the gain value to become larger as the load value becomes smaller.

In an embodiment, the display device may further include a still area detector and a load calculator. The method may further include detecting, by the still area detector, the first area of the input image as the still area, and providing the grayscale values of the first area, and calculating, the load calculator, as the load value, an average value of the grayscale values of the entire area of the input image.

BRIEF DESCRIPTION OF THE DRAWINGS

Embodiments, features and advantages will now be described more fully hereinafter with reference to the accompanying drawings.

DETAILED DESCRIPTION

Figure 1:
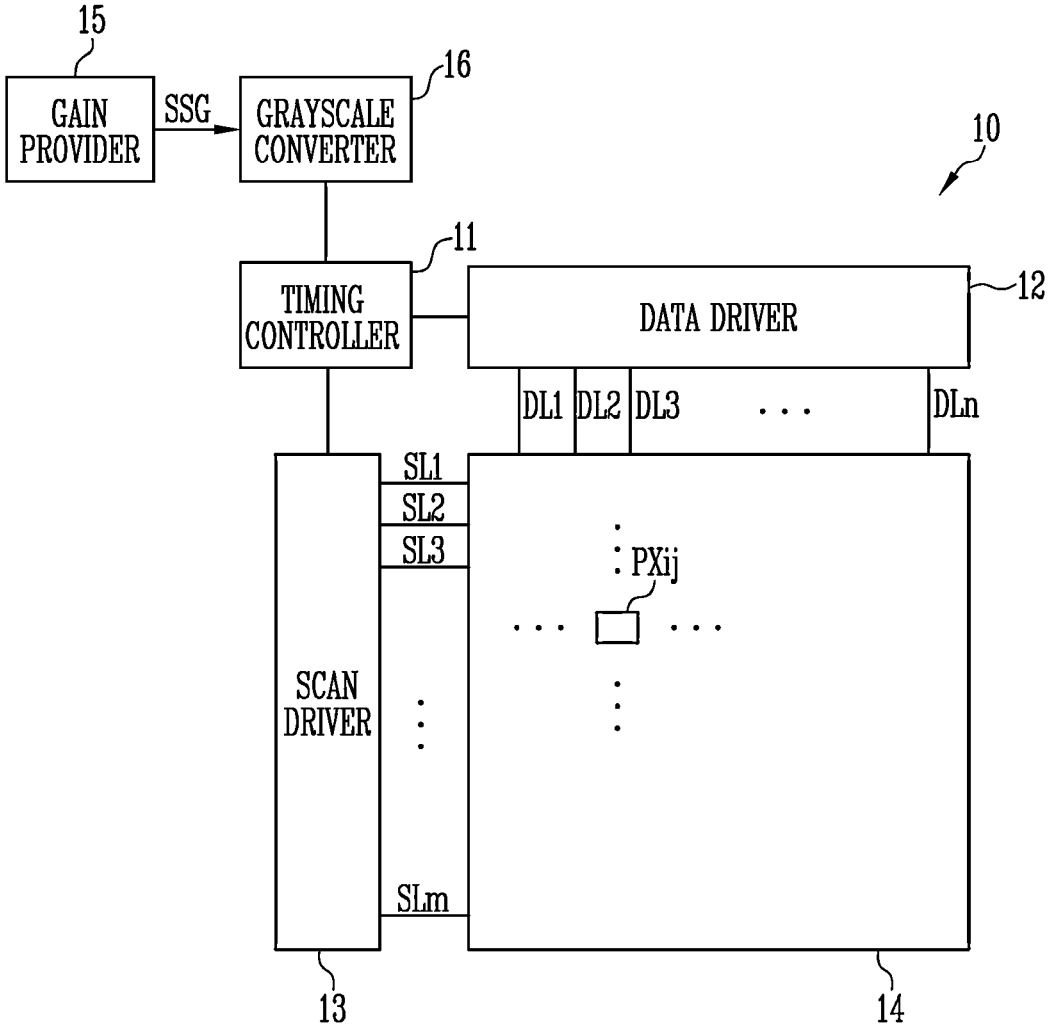
FIG. 1 is a diagram illustrating an embodiment of a display device in accordance with the invention.

Hereinafter, embodiments will be described in detail with reference to the accompanying drawings. The effects and characteristics of the disclosure and a method of achieving the effects and characteristics will be clear by referring to the embodiments described below in detail together with the accompanying drawings. However, the disclosure is not limited to the embodiments disclosed herein but may be implemented in various forms. The embodiments are provided by way of example only so that a person of ordinary skilled in the art can fully understand the features in the disclosure and the scope thereof. Therefore, the disclosure can be defined by the scope of the appended claims. Like reference numerals generally denote like elements throughout the specification.

Embodiments may be embodied in different forms and should not be construed as limited to the embodiments set forth herein. Rather, these embodiments are provided so that this invention will be thorough and complete, and will fully convey the scope of the embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein. As used herein, the singular forms are intended to include the plural forms as well, unless the context clearly indicates otherwise. Terms such as "unit" may refer to a circuit or processor, for example.

Hereinafter, a display device in an embodiment of the invention will be described with reference to FIG. 1.

FIG. 1 is a diagram illustrating an embodiment of a display device in accordance with the invention.

The display device 10 in the embodiment of the invention may include a timing controller 11, a data driver 12, a scan driver 13, a pixel unit 14, a gain provider 15, and a grayscale converter 16.

The timing controller 11 may receive grayscale values for each input image and control signals from an external processor (not shown).

In an embodiment, in the case of a still image, grayscale values of input images sequentially displayed in units of frames may be substantially the same, for example. In the case of a moving image, grayscale values of input images sequentially displayed in units of frames may be substantially different from each other.

An image may simultaneously include a still image part and a moving image part. Grayscale values of input images sequentially displayed in units of frames may be substantially the same at the still image part, and be substantially different from each other at the moving image part.

Also, the timing controller 11 may provide the data driver 12 and the scan driver 13 with control signals suitable for specifications of the data driver 12 and the scan driver 13 so as to display an output image.

The gain provider 15 may provide a gain value SSG, based on an input image.

Specifically, the gain provider 15 may set, as a set time, a time for which a set period elapses from a time at which a first area as a partial area of an input image IMG1 (refer to FIG. 4) is detected as a still image, and gradually decrease the gain value SSG from the set time.

The gain provider 15 may differently set a set period pSET (refer to FIG. 3) and a saturation level GSAT (refer to FIG. 3) and a final level GF (refer to FIG. 3) of the gain value SSG (refer to FIG. 3) according to a histogram of the first area as the partial area of the input image IMG1. Also, the gain provider 15 may differently set the set period pSET and the saturation level GSAT and the final level GF of the gain value SSG according to a load value corresponding to an average value of grayscale values of a second area as the entire area of the input image IMG1.

The grayscale converter 16 may generate an output image by applying the gain value SSG to the input image IMG1.

Specifically, the gain value SSG may be a value of 0 or more and 1 or less. In an alternative embodiment, the gain value SSG may be a value of 0 percent (%) or more and 100% or less. In addition, the gain value may be represented by various expression methods.

The grayscale converter 16 may calculate grayscale values of the output image by multiplying grayscale values of the input image IMG1 and the gain value SSG.

Specifically, the grayscale converter 16 may generate grayscale values of the output image by decreasing the grayscale values of the input image IMG1 at a ratio according to the gain value SSG. The timing controller 11 may provide the data driver 12 with the grayscale values of the output image, which are generated by the grayscale converter 16.

The data driver 12 may generate data voltages to be provided to data lines DL1 to DLn (n is an integer greater than 0) by the grayscale values of the output image and the control signals.

Specifically, the data driver 12 may sample the grayscale values transferred from the timing controller 11 by a clock signal, and apply data voltages corresponding to the sampled grayscale values to the data lines DL1 to DLn in units of pixel rows.

In an embodiment, the pixel row may mean pixels PXij connected to the same scan line.

The scan driver 13 may generate scan signals to be provided to scan lines SL1 to SLm (m is an integer greater than 0) by receiving a clock signal, a scan start signal, and the like from the timing controller 11.

Also, the scan driver 13 may sequentially supply the scan signals having a pulse of a turn-on level to the scan lines SL1 to SLm. Also, the scan driver 13 may include a scan stages (not shown) configured in the form of shift registers.

Specifically, the scan driver 13 may generate scan signals in a manner that sequentially transfers the scan start signal in the form of a pulse of a turn-on level to a next scan stage under the control of the clock signal.

The pixel unit 14 includes a plurality of pixels PXij. Each pixel PXij may be connected to a corresponding data line and a corresponding scan line. Here, i and j may be integers greater than 0 and may be equal to or less than m and n, respectively. The pixel PXij may mean a pixel in which a scan transistor is connected to an ith scan line and a jth data line.

Hereinafter, a pixel in an embodiment of the invention will be described with reference to FIG. 2.

Figure 2:
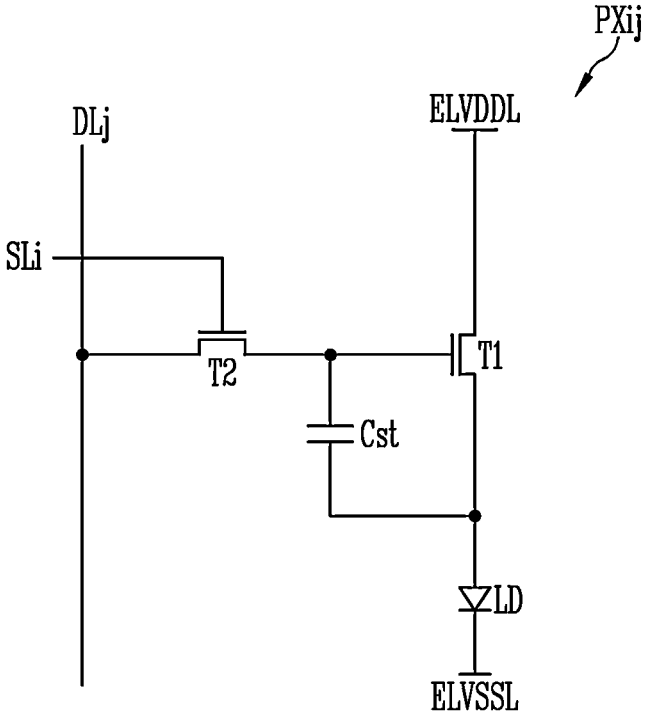
FIG. 2 is a diagram illustrating an embodiment of a pixel in accordance with the invention.

FIG. 2 is a diagram illustrating an embodiment of a pixel in accordance with the invention.

Hereinafter, a circuit implemented with an N-type transistor is described as an example. However, a circuit implemented with a P-type transistor may be designed by changing the polarity of a voltage applied to a gate terminal. In addition, a circuit implemented with a combination of the P-type transistor and the N-type transistor may be designed.

The P-type transistor refers to a transistor in which an amount of current flowing when the difference in voltage between a gate electrode and a source electrode increases in a negative direction increases. The N-type transistor refers to a transistor in which an amount of current flowing when the difference in voltage between a gate electrode and a source electrode increases in a positive direction increases.

In an embodiment, the transistor may be configured in various forms including a thin film transistor ("TFT"), a field effect transistor ("FET"), a bipolar junction transistor ("BJT"), and the like.

A gate electrode of a first transistor T1 may be connected to one end of a storage capacitor Cst, a first electrode of the first transistor T1 may be connected to a first power line ELVDDL, and a second electrode of the first transistor T1 may be connected to the other end of the storage capacitor Cst. The first transistor T1 may be also referred to as a driving transistor.

A gate electrode of a second transistor T2 may be connected to an ith scan line SLi, a first electrode of the second transistor T2 may be connected to a jth data line DLj, and a second electrode of the second transistor T2 may be connected to the gate electrode of the first transistor T1. The second transistor T2 may be also referred to as a scan transistor.

The one end of the storage capacitor Cst may be connected to the gate electrode of the first transistor T1, and the other end of the storage capacitor Cst may be connected to the second electrode of the first transistor T1.

An anode of a light emitting diode LD may be connected to the second electrode of the first transistor T1, and a cathode of the light emitting diode LD may be connected to a second power line ELVSSL.

The light emitting diode LD may be configured as an organic light emitting diode, an inorganic light emitting diode, a quantum dot/well light emitting diode, or the like.

One light emitting diode LD is provided in the pixel PXij shown in FIG. 2. However, in another embodiment, the pixel PXij may include a plurality of light emitting diodes connected in series, parallel or series/parallel.

A first power voltage may be applied to the first power line ELVDDL, and a second power voltage may be applied to the second power line ELVSSL. The first power voltage may have a magnitude greater than that of the second power voltage.

When a scan signal of a turn-on level (logic high level) is applied through the scan line SLi, the second transistor T2 is in a turn-on state. A data voltage applied to the data line DLj is stored in the storage capacitor Cst.

A driving current having an amount corresponding to a voltage difference between both the ends of the storage capacitor Cst flows between the first electrode and the second electrode of the first transistor T1. Accordingly, the light emitting diode LD emits light with a luminance corresponding to the data voltage.

In addition, when a scan signal of a turn-off level (logic low level) is applied through the scan line SLi, the second transistor T2 is turned off, and the data line DLj and the storage capacitor Cst are electrically isolated from each other.

Thus, although the data voltage of the data line DLj is changed, the voltage stored in the storage capacitor Cst is not changed.

Hereinafter, an operation of the gain provider in an embodiment of the invention will be described with reference to FIG. 3.

Figure 3:
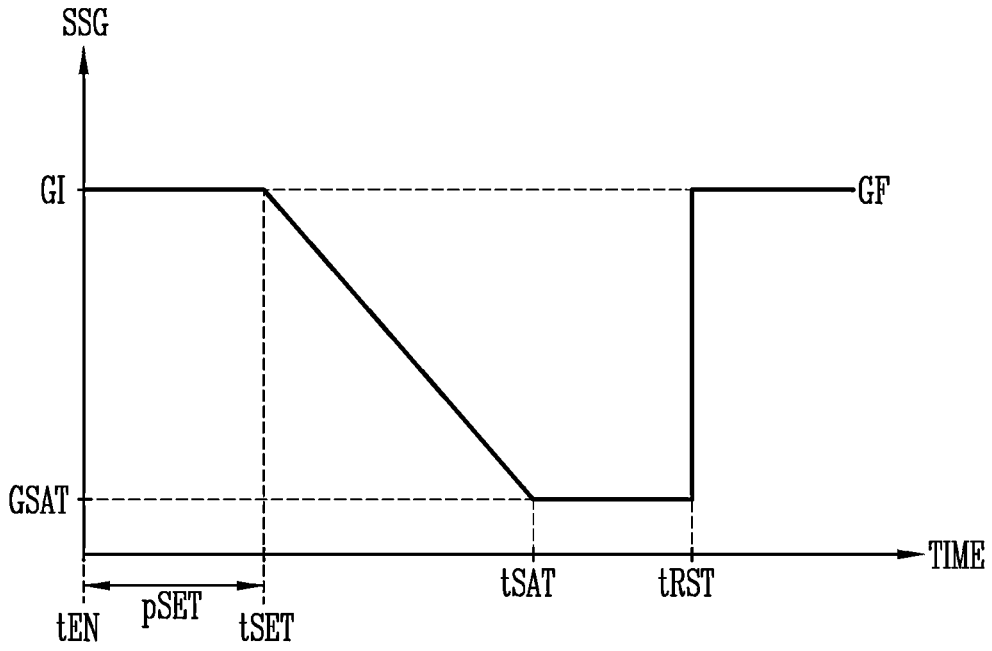
FIG. 3 is a diagram illustrating an embodiment of an operation of a gain provider in accordance with the invention.

FIG. 3 is a diagram illustrating an embodiment of an operation of the gain provider in accordance with the invention.

Referring to FIG. 3, gain value SSG provided by the gain provider 15 according to lapse of time is illustrated.

An enable time tEN means a time at which the first area of the input image IMG1 is detected as a still area. When the whole or a partial area of the input image IMG1 is detected as the still area, an afterimage is prevented by lowering luminance of the image as described above, and a screen saver function may be enabled so as to reduce power consumption.

A gain value SSG which the gain provider 15 provides at the enable time tEN may have a value of an initial level GI.

In addition, the gain provider 15 may set, as a set time tSET, a time for which a set period pSET elapses from the enable time tEN. The gain provider 15 may gradually decrease a gain value SSG of the initial level GI from the set time tSET.

Specifically, the gain provider 15 may gradually decrease the gain value SSG until the gain value SSG reaches a saturation level GSAT.

A saturation time tSAT may be a time at which the gain value SSG reaches a minimum level as the saturation level GSAT. Also, the gain provider 15 may maintain the gain value SSG during a predetermined period (tSAT to tRST) from the saturation time tSAT.

A reset time tRST may be a time at which it is determined that the first area is no longer the still area.

Specifically, this may be a case where a still image of the first area is changed to another still image or changed to a moving image. Also, the gain provider 15 may increase the gain value SSG from the saturation level GSAT to a final level GF. In the embodiment shown in FIG. 3, a case where the initial level GI and the final level GF of the gain value SSG are the same is assumed. However, the invention is not limited thereto, and the initial level GI and the final level GF of the gain value SSG may be different from each other according to an average value of grayscale values of the first area and/or the second area, which will be described below.

In the invention, the set time tSET may be changed. When the set time tSET becomes fast, a luminance change may be viewed by a user. When the set time tSET becomes slow, the effect of afterimage prevention and power consumption reduction may be reduced. Therefore, it is necessary to set an appropriate set time tSET.

Hereinafter, areas of an input image in an embodiment of the invention will be described with reference to FIG. 4.

Figure 4:
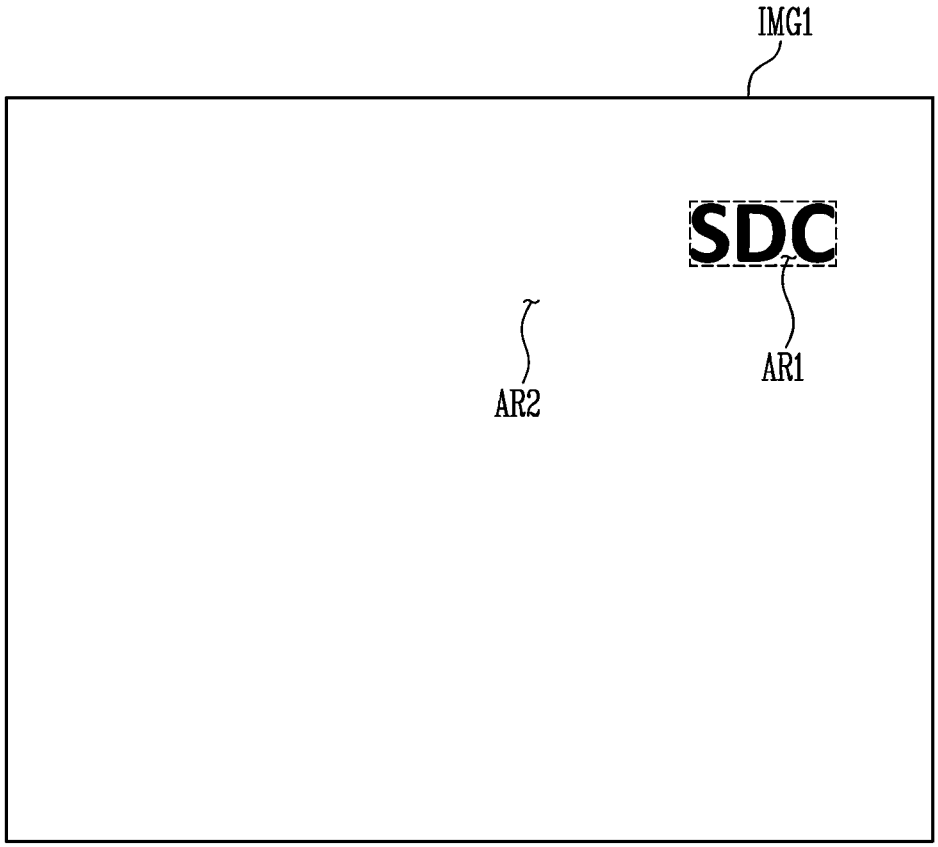
FIG. 4 is a diagram illustrating an embodiment of areas of an input image in accordance with the invention.

FIG. 4 is a diagram illustrating an embodiment of areas of an input image in accordance with the invention.

The input image IMG1 may include a first area AR1 detected as a still area.

Specifically, the first area AR1 may display a logo, a banner, or the like. Also, the first area AR1 may be a quadrangular area surrounding the exterior of the logo. Also, the first area AR1 may be an area having a shape which accords with the exterior of the logo.

In addition, the input image IMG1 may include a first area AR1 and a second area AR2 including a peripheral area of the first area AR1.

Specifically, the second area AR2 may be a partial area of the input image IMG1. Also, the second area AR2 may be the entire area of the input image IMG1.

First pixels of the pixel unit 14 (refer to FIG. 1) in the embodiment of the invention may display a still image part in the first area AR1. In addition, second pixels of the pixel unit 14 may display a moving image part in the peripheral area of the first area AR1 (e.g., the second area AR2).

An average luminance of the first pixels is gradually decreased from the enable time tEN as a display start time of the still image part to a first time (e.g., the set time tSET) for which the set period pSET as a first period elapses. Additionally, the second pixels included in the second area may display the moving image part, and maintain or decrease an average luminance of the second pixels.

Hereinafter, a gain provider including a still area detector in an embodiment of the invention will be described with reference to FIGS. 5 to 7.

Figure 5:
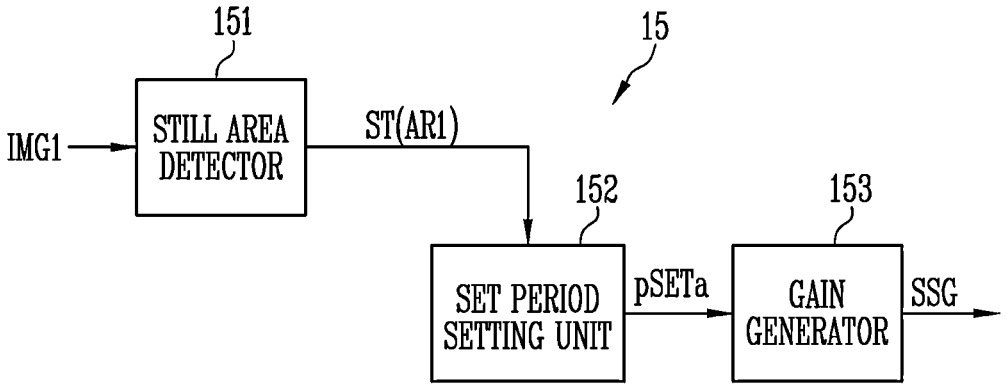
FIG. 5 is a diagram illustrating an embodiment of a gain provider including a still area detector in accordance with the invention.

Referring to FIG. 5, the gain provider 15 in the embodiment of the invention may include a still area detector 151, a set period setting unit 152, and a gain generator 153.

The still area detector 151 in the embodiment of the invention may detect a first area AR1 of an input image IMG1 as a still area, and provide the set period setting unit 152 with grayscale values ST(AR1) of the first area AR1 detected as the still area.

Specifically, the still area detector 151 may detect whether the input image IMG1 includes any still area by comparing grayscale values of the input image IMG1 in a previous frame period with grayscale values of the input image IMG1 in a current frame period.

In an embodiment, the still area detector 151 may detect, as a still area, a first area AR1 in which a difference between the grayscale values of the input image IMG1 in the previous frame period and the grayscale values of the input image IMG1 in the current frame period is a reference value or less, for example. The first area AR1 may include the entire area of the pixel unit 14.

The set period setting unit 152 may calculate a histogram of pixels constituting the first area AR1 by the received grayscale values ST(AR1) of the first area AR1, and set a set period pSETa by the histogram.

Specifically, the set period setting unit 152 calculates a histogram of each of red R, green G, and blue B included in the pixels PXij constituting the first area AR1.

The set period setting unit 152 calculates a maximum grayscale value Max_Gray (refer to FIG. 6A) in the histogram of each of the R, G, and B.

Also, when the calculated maximum grayscale value is a predetermined grayscale value or more, the set period setting unit 152 may determine that a grayscale value of the first area AR1 is large, and set the set period pSETa to be short.

Hereinafter, a process in which the set period setting unit 152 sets the set period pSETa according to the calculated maximum grayscale value will be described with reference to FIG. 6.

Figure 6A:
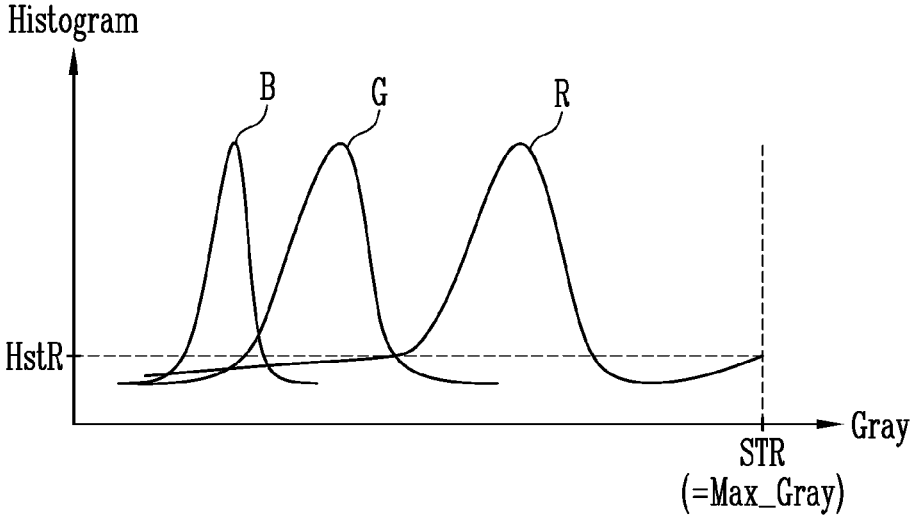
FIG. 6A is a diagram illustrating an embodiment of a process in which a set period setting unit calculates a maximum grayscale value Max_Gray in a calculated histogram of each of R, G, and B in accordance with the invention.
Figure 6B:
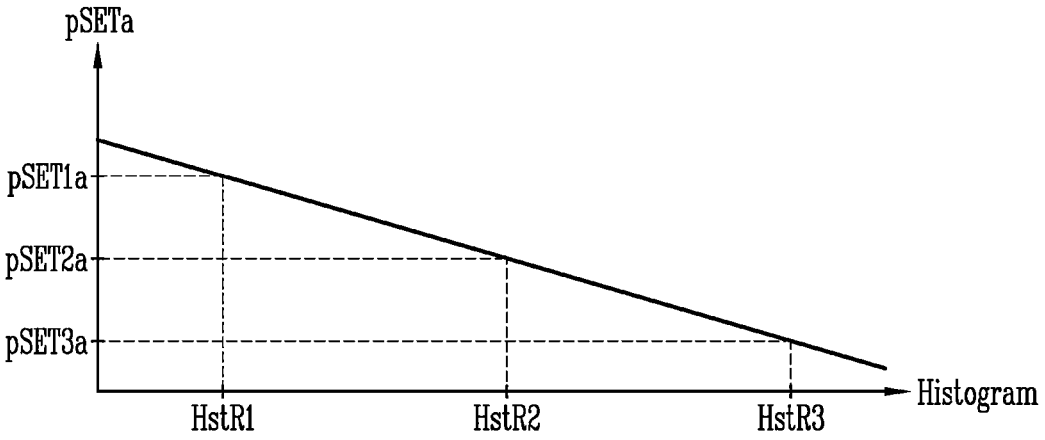
FIG. 6B is a diagram illustrating an embodiment of a process in which the set period setting unit sets a set period pSETa by the calculated maximum grayscale value Max_Gray in accordance with the invention.
Figure 6C:
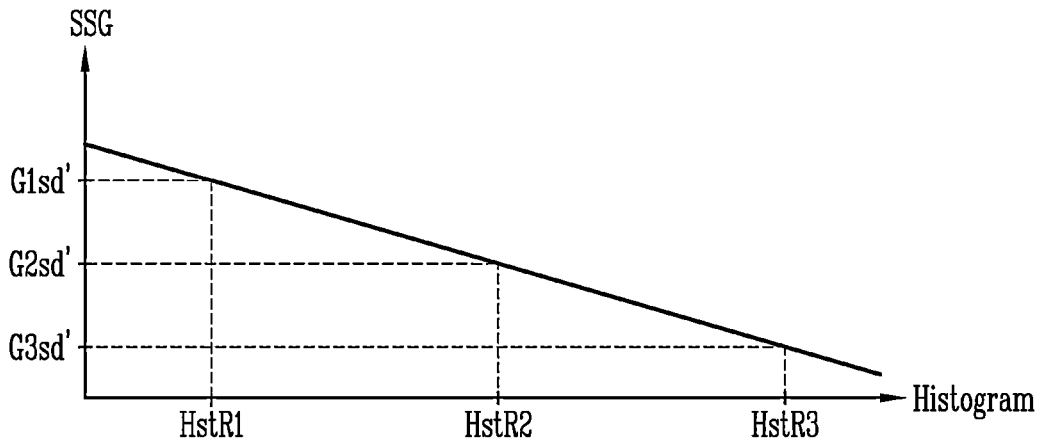
FIG. 6C is a diagram illustrating an embodiment of a process in which the gain generator sets a final level GF of a gain value SSG in accordance with the invention.
Figure 6D:
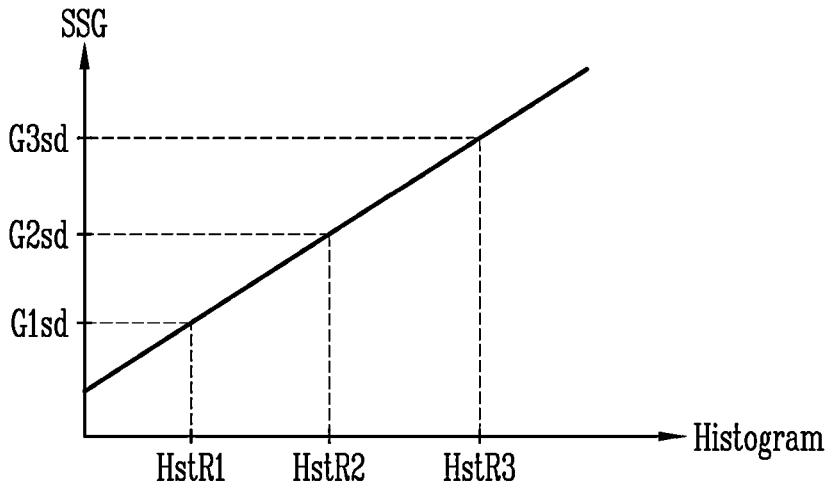
FIG. 6D is a diagram illustrating an embodiment of a process in which the gain generator sets a saturation level GSAT of the gain value SSG in accordance with the invention.

FIG. 6A is a diagram illustrating an embodiment of a process in which the set period setting unit calculates a maximum grayscale value Max_Gray in the calculated histogram of each of the R, G, and B in accordance with the invention. FIG. 6B is a diagram illustrating an embodiment of a process in which the set period setting unit sets a set period pSETa by the calculated maximum grayscale value Max_Gray in accordance with the invention. FIG. 6C is a diagram illustrating an embodiment of a process in which the gain generator sets a final level GF of a gain value SSG in accordance with the invention. FIG. 6D is a diagram illustrating an embodiment of a process in which the gain generator sets a saturation level GSAT of the gain value SSG in accordance with the invention.

Referring to FIG. 6A, the set period setting unit 152 (refer to FIG. 5) calculates a histogram of each of red R, green G, and blue B as the pixels PXij constituting the first area AR1.

Also, the set period setting unit 152 calculates a maximum grayscale value Max_Gray in the calculated histogram of each of the R, G, and B.

When lifetimes of the pixels PXij of the R, G, and B are different from each other, the set period setting unit 152 may set the set period pSETa to be short, when a maximum grayscale value STR having a largest grayscale value Gray in the histogram of the R, the histogram of the G, and the histogram of the B is a predetermined grayscale value or more.

Specifically, referring to FIG. 6A, when a maximum grayscale value STR of the R, which has a largest grayscale value in the histogram of the R, the histogram of the G, and the histogram of the B, is the predetermined grayscale value or more, the set period setting unit 152 calculates a histogram value HstR corresponding to the maximum grayscale value STR of the R on the histogram.

Also, the set period setting unit 152 may set a set period pSETa corresponding to the calculated histogram value HstR. Hereinafter, a process in which the set period setting unit 152 sets the set period pSETa by the calculated histogram value HstR will be described with reference to FIG. 6B.

Referring to FIG. 6B, when the calculated histogram value HstR is a first histogram value HstR1, the set period setting unit 152 may set the set period pSETa as a first period pSET1*a*. Also, when the calculated histogram value HstR is a second histogram value HstR2, the set period setting unit 152 may set the set period pSETa as a second period pSET2*a*. Also, when the calculated histogram value HstR is a third histogram value HstR3, the set period setting unit 152 may set the set period pSETa as a third period pSET3*a*.

The second period pSET2*a* may be shorter than the first period pSET1*a*, and the third period pSET3*a* may be shorter than the second period pSET2*a*. The periods pSET1*a*, pSET2*a*, and pSET3*a* with respect to the histogram values HstR1, HstR2, and HstR3 may be pre-stored in a lookup table, etc., or be calculated by an algorithm.

Figure 7:
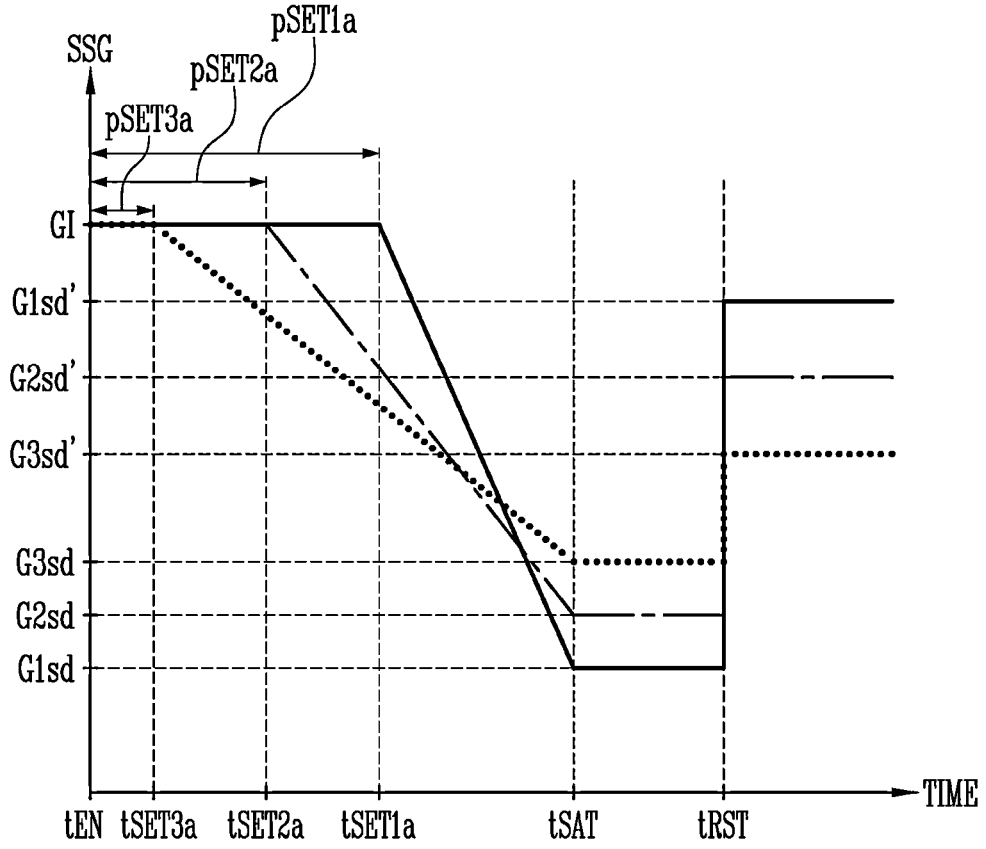
FIG. 7 is a diagram illustrating an embodiment of an operation of the set period setting unit and the gain generator in accordance with the invention.

Referring to FIGS. 6B and 7, when the histogram value HstR is the second histogram value HstR2, the gain value SSG may be gradually decreased from a time earlier than that at which the histogram value HstR is the first histogram value HstR1. Also, when the histogram value HstR is the third histogram value HstR3, the gain value SSG may be gradually decreased from a time earlier than that at which the histogram value HstR is the second histogram value HstR2.

Accordingly, an appropriate set time tSET may be set corresponding to the determined histogram value HstR.

Referring to FIG. 6C, when the histogram value HstR is the first histogram value HstR1, the gain generator 153 (refer to FIG. 5) may set the final level GF of the gain value SSG as a first gain value G1*sd'*. Also, the histogram value HstR is the second histogram value HstR2, the set period setting unit 152 may set the final level GF of the gain value SSG as a second gain value G2*sd'*. Also, the histogram value HstR is the third histogram value HstR3, the set period setting unit 152 may set the final level GF of the gain value SSG as a third gain value G3*sd'*.

The second gain value G2*sd'* may be smaller than the first gain value G1*sd'*, and the third gain value G3*sd'* may be smaller than the second gain value G2*sd'*. The final level values G1*sd'*, G2*sd'*, and G3*sd'* of the gain value SSG with respect to the histogram values HstR1, HstR2, and HstR3 may be pre-stored in a lookup table, etc., or be calculated by an algorithm.

Accordingly, the final level GF of the gain value SSG may be set corresponding to the determined histogram value HstR.

Referring to FIG. 6D, when the histogram value HstR is the first histogram value HstR1, the gain generator 153 may set the saturation level GSAT of the gain value SSG as a first gain value G1*sd*. Also, when the histogram value HstR is the second histogram value HstR2, the set period setting unit 152 may set the saturation level GSAT of the gain value SSG as a second gain value G2*sd*. Also, when the histogram value HstR is the third histogram value HstR3, the set period setting unit 152 may set the saturation level GSAT of the gain value SSG as a third gain value G3*sd*.

The second gain value G2*sd* may be greater than the first gain value G1*sd*, and the third gain value G3*sd* may be greater than the third gain value G3*sd*. The saturation level values G1*sd*, G2*sd*, and G3*sd* of the gain value SSG with respect to the histogram values HstR1, HstR2, and HstR3 may be pre-stored in a lookup table, etc., or be calculated by an algorithm.

Accordingly, the saturation level GSAT of the gain value SSG may be set corresponding to the determined histogram value HstR.

Referring to FIG. 7, when the histogram value HstR is the first histogram value HstR1, the set period setting unit 152 may set, as the set time tSET, a first time tSET1*a* for which the first period pSET1*a* elapses from the enable time tEN. In addition, the gain generator 153 may set the final level GF of the gain value SSG as the first gain value G1*sd'*, corresponding to the first time tSET1*a*. Also, the gain generator 153 may set the saturation level GSAT of the gain value SSG as the first gain value G1*sd*, corresponding to the first gain value G1*sd'*.

In addition, when the histogram value HstR is the second histogram value HstR2, the set period setting unit 152 may set, as the set time tSET, a second time tSET2*a* for which the second period pSET2*a* elapses from the enable time tEN. In addition, the gain generator 153 may set the final level GF of the gain value SSG as the second gain value G2*sd'*, corresponding to the second time tSET2*a*. Also, the gain generator 153 may set the saturation level GSAT of the gain value SSG as the second gain value G2*sd*, corresponding to the second gain value G2*sd'*.

In addition, when the histogram value HstR is the third histogram value HstR3, the set period setting unit 152 may set, as the set time tSET, a third time tSET3*a* for which the third period pSET3*a* elapses from the enable time tEN. In addition, the gain generator 153 may set the final level GF of the gain value SSG as the third gain value G3*sd'*, corresponding to the third time tSET3*a*. Also, the gain generator 153 may set the saturation level GSAT of the gain value SSG as the third gain value G3*sd*, corresponding to the third gain value G3*sd'*.

The first time tSET1*a* may be later than the second time tSET2*a*, and the second time tSET2*a* may be later than the third time tSET3*a*.

In addition, as the final level GF of the gain value SSG, the third gain value G3*sd'* is smaller than the second gain value G2Sd', and the second gain value G2*sd'* is smaller than the first gain value G1*sd'*.

In addition, as the saturation level GSAT of the gain value SSG, the third gain value G3*sd* is greater than the second gain value G2*sd*, and the second gain value G2*sd* is greater than the first gain value G1*sd*.

Specifically, when the gain generator 153 receives the set period pSETa of the second period pSET2*a*, the gain generator 153 gradually decreases the gain value SSG from the second time tSET2*a*, which is earlier than the first time tSET1*a* when the gain generator 153 receives the set period pSETa of the first period pSET1*a*, to the saturation time tSAT at which the gain value SSG reaches the saturation level GSAT. The gain value SSG is decreased down to the second gain value G2*sd* as the saturation level GSAT of the gain value SSG, which is higher than the first gain value G1*sd*. Also, the gain generator 153 increases the gain value SSG up to the second gain value G2*sd'* as the final level GF of the gain value SSG, which is a gain value lower than the first gain value G1*sd'*.

In addition, when the gain generator 153 receives the set period pSETa of the third period pSET3*a*, the gain generator 153 gradually decreases the gain value SSG from the third time tSET3*a*, which is earlier than the second time tSET2*a* when the gain generator 153 receives the set period pSETa of the second period pSET2*a*, to the saturation time tSAT at which the gain value SSG reaches the saturation level GSAT. The gain value SSG is decreased down to the third gain value G3*sd* as the saturation level GSAT of the gain value SSG, which is higher than the second gain value G2*sd*. Also, the gain generator 153 increases the gain value SSG up to the third gain value G3*sd'* as the final level GF of the gain value SSG, which is a gain value lower than the second gain value G2*sd'*.

Thus, the set time tSET, the saturation level GSAT of the gain value SSG, and the final level GF of the gain value SSG are appropriately set corresponding to the histogram value HstR, so that the effect of afterimage prevention and power consumption reduction may be increased.

Specifically, when the histogram value is high, the set time tSET is set fast, so that the effect of afterimage prevention may be increased. Further, the degradation of a display panel and reduction in the lifetime of an element may be prevented. Furthermore, the final level GF of the gain value SSG decreases, so that the effect of power consumption reduction may be increased.

Figure 8:
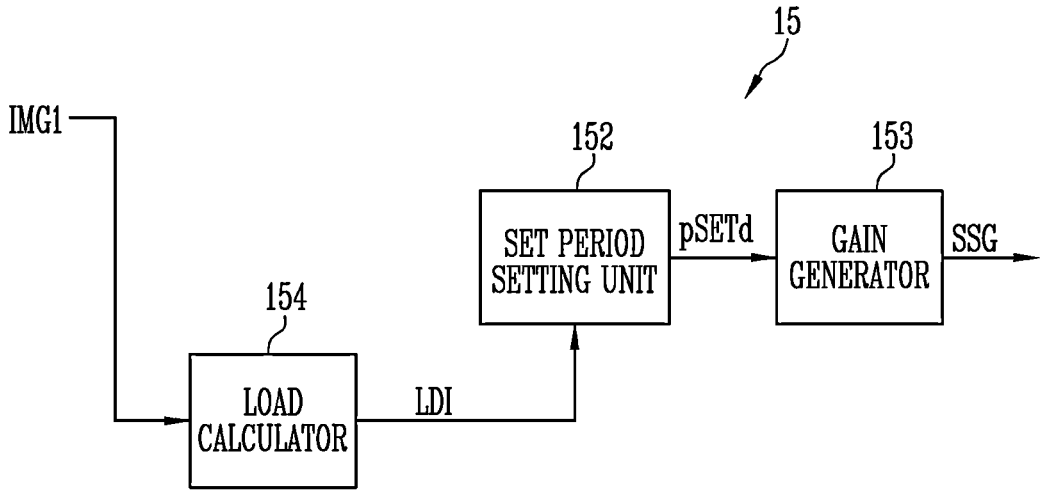
FIG. 8 is a diagram illustrating an embodiment of a gain provider including a load calculator in accordance with the invention.
Figure 9A:
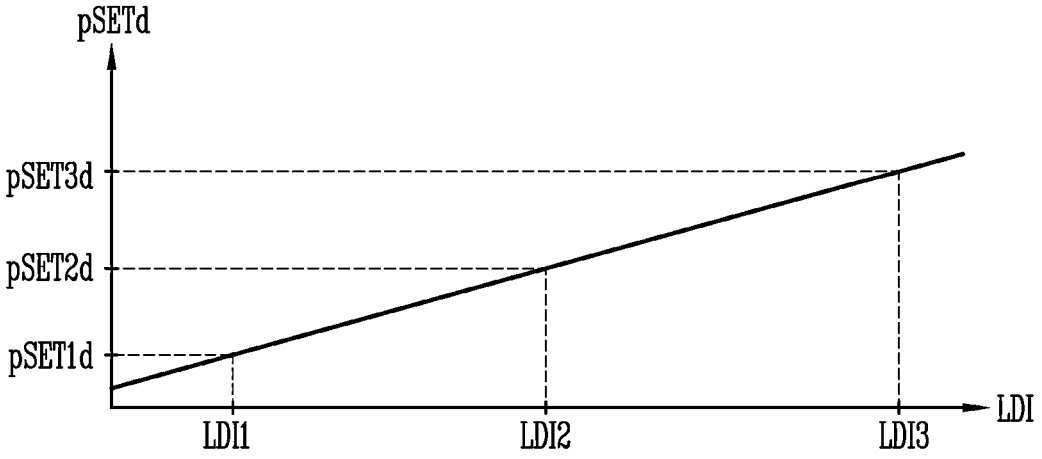
FIG. 9A is a diagram illustrating an embodiment of a process of setting a set period by a load value in accordance with the invention.
Figure 9B:
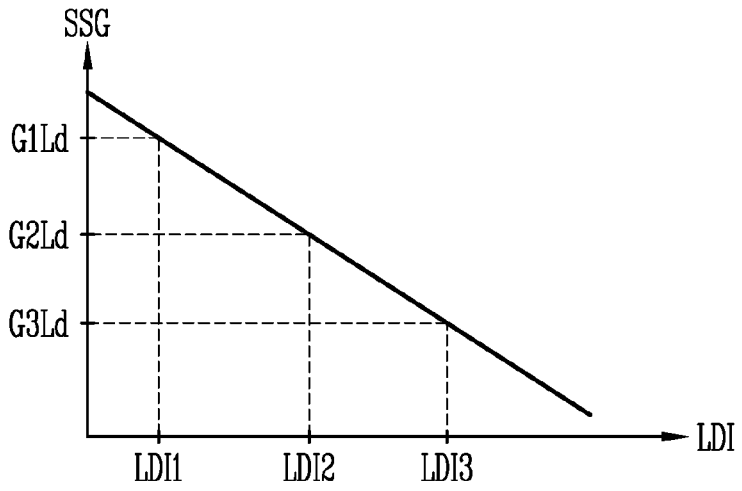
FIG. 9B is a diagram illustrating an embodiment of a process of setting a saturation level of a gain value by the load value in accordance with the invention.
Figure 9C:
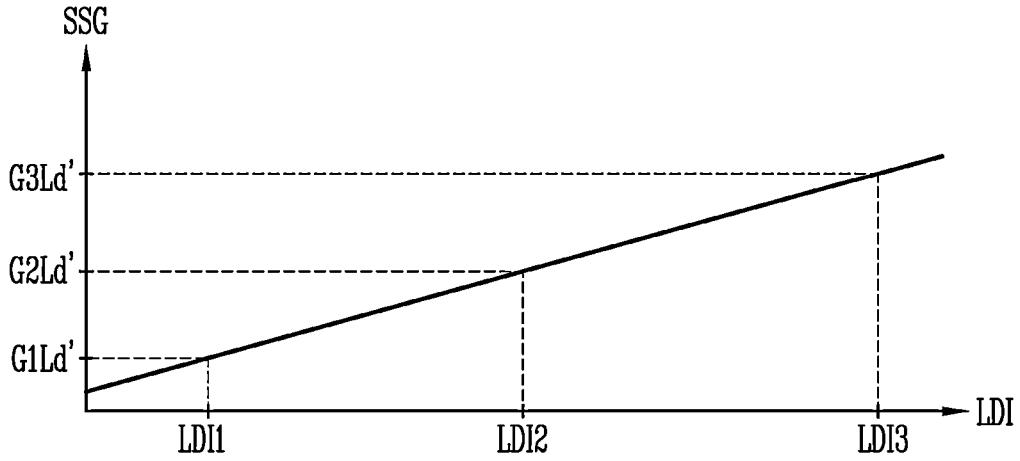
FIG. 9C is a diagram illustrating of an embodiment of setting a final level of the gain value by the load value in accordance with the invention.
Figure 10:
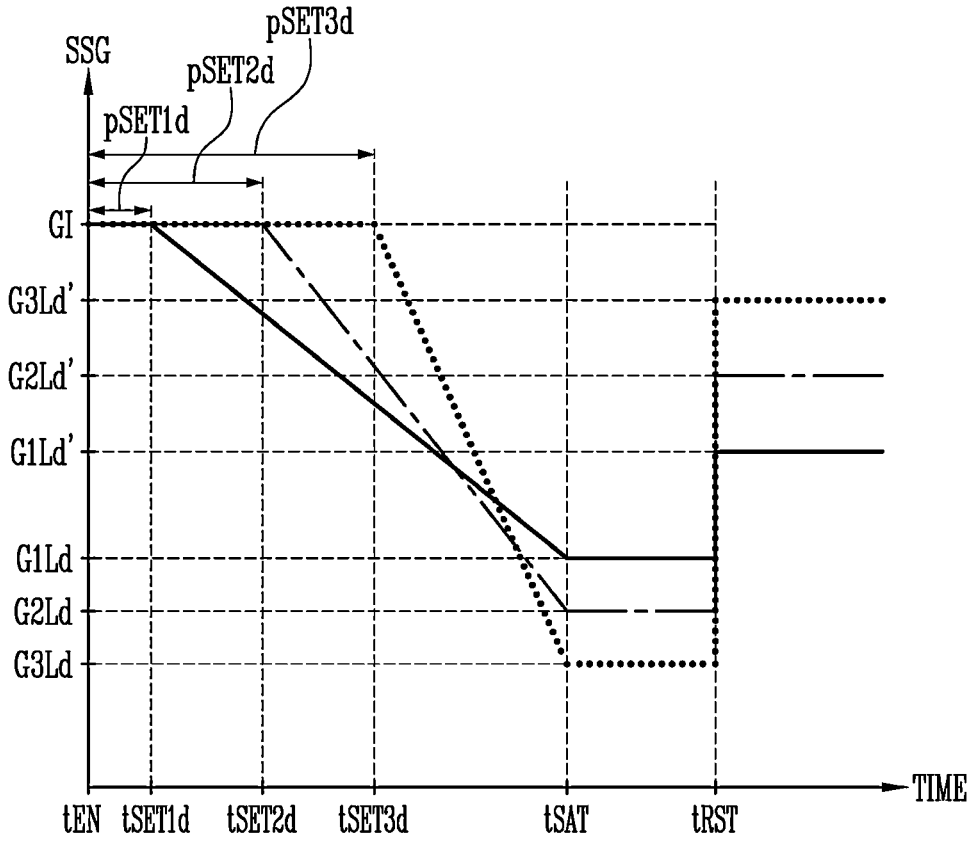
FIG. 10 is a diagram illustrating an embodiment of an operation of the load calculator and the gain generator in accordance with the invention.

FIGS. 8 to 10 are diagrams illustrating an embodiment of a gain provider including a load calculator in accordance with the invention.

Referring to FIG. 8, the gain provider 15 may include a load calculator 154, a set period setting unit 152, and a gain generator 153.

The gain provider 15 may set a set period pSETd, and a saturation level GSAT (refer to FIG. 3) and a final level GF (refer to FIG. 3) of a gain value SSG, corresponding to a load value LDI of the input image IMG1 (refer to FIG. 4).

In an embodiment, the load value LDI may be a sum value or average value of grayscale values of the second area AR2 (refer to FIG. 4) as the entire area of the input image IMG1, for example.

The load calculator 154 may calculate, as the load value LDI, the sum value or average value of the grayscale values of the entire area of the input image IMG1. In another embodiment, the load calculator 154 may use a load value detection algorithm in accordance with a conventional art.

The set period setting unit 152 may set the set period pSETd to become longer as the load value LDI becomes larger. In addition, the gain generator 153 may set the saturation level GSAT of the gain value SSG to become smaller as the load value LDI becomes larger. Also, the gain generator 153 may set the final level GF of the gain value SSG to become larger as the load value LDI becomes larger.

Referring to FIG. 9A, when the load value LDI is a first level LDI1, the set period setting unit 152 may set the set period pSETd as a first period pSET1*d*. Also, when the load value LDI is a second level LDI2, the set period setting unit 152 may set the set period pSETd as a second period pSET2*d*. Also, when the load value LDI is a third level LDI3, the set period setting unit 152 may set the set period pSETd as a third period pSET3*d*.

A sum value or average value of grayscale values of the entire area of the input image IMG1 at the second level LDI2 is greater than that of grayscale values of the entire area of the input image IMG1 at the first level LDI1.

In addition, a sum value or average value of grayscale values of the entire area of the input image IMG1 at the third level LDI3 is greater than that of the grayscale values of the entire area of the input image IMG1 at the second level LDI2.

The second period pSET2*d* may be longer than the first period pSET1*d*, and the third period pSET3*d* may be longer than the second period pSET2*d*. The periods pSET1*d*, pSET2*d*, and pSET3*d* with respect to the levels LDI1, LDI2, and LDI3 may be pre-stored in a lookup table, etc., or be calculated by an algorithm.

Referring to FIG. 9B, when the load value LDI is the first level LDI1, the gain generator 153 may set the saturation level GSAT of the gain value SSG as a first gain value G1Ld. Also, when the load value LDI is the second level LDI2, the gain generator 153 may set the saturation level GSAT of the gain value SSG as a second gain value G2Ld. Also, when the load value LDI is the third level LDI3, the gain generator 153 may set the saturation level GSAT of the gain value SSG as a third gain value G3Ld.

The first gain value G1Ld may be greater than the second gain value G2Ld, and the second gain value G2Ld may be greater than the third gain value G3Ld. The saturation levels G1Ld, G2Ld, and G3Ld of the gain value SSG with respect to the levels LDI1, LDI2, and LDI3 may be pre-stored in a lookup table, etc., or be calculated by an algorithm.

Referring to FIG. 9C, when the load value LDI is the first level LDI1, the gain generator 153 may set the final level GF of the gain value SSG as a first gain value G1Ld'. Also, when the load value LDI is the second level LDI2, the gain generator 153 may set the final level GF of the gain value SSG as a second gain value G2Ld'. Also, when the load value LDI is the third level LDI3, the gain generator 153 may set the final level GF of the gain value SSG as a third gain value G3Ld'.

The first gain value G1Ld' may be smaller than the second gain value G2Ld', and the second gain value G2Ld' may be smaller than the third gain value G3Ld'. The final levels G1Ld', G2Ld', and G3Ld' of the gain value SSG with respect to the levels LDI1, LDI2, and LDI3 may be pre-stored in a lookup table, etc., or be calculated by an algorithm.

Referring to FIG. 10, when the load value LDI is the first level LDI1, the gain generator 153 may set, as the set time tSET, a first time tSET1*d* for which the first period pSET1*d* elapses from the enable time tEN. Also, when the load value LDI is the first level LDI1, the gain generator 153 may set the final level GF of the gain value SSG as the first gain value G1Ld'. Also, when the load value LDI is the first level LDI1, the gain generator 153 may set the saturation level GSAT of the gain value SSG as the first gain value G1Ld.

Also, when the load value LDI is the second level LDI2, the gain generator 153 may set, as the set time tSET, a second time tSET2*d* for which the second period pSET2*d* elapses from the enable time tEN. Also, when the load value LDI is the second level LDI2, the gain generator 153 may set the final level GF of the gain value SSG as the second gain value G2Ld'. Also, when the load value LDI is the second level LDI2, the gain generator 153 may set the saturation level GSAT of the gain value SSG as the second gain value G2Ld.

Also, when the load value LDI is the third level LDI3, the gain generator 153 may set, as the set time tSET, a third time tSET3*d* for which the third period pSET3*d* elapses from the enable time tEN. Also, when the load value LDI is the third level LDI3, the gain generator 153 may set the final level GF of the gain value SSG as the third gain value G3Ld'. Also, when the load value LDI is the third level LDI3, the gain generator 153 may set the saturation level GSAT of the gain value SSG as the third gain value G3Ld.

The first time tSET1*d* may be earlier than the second time tSET2*d*, and the second time tSET2*d* may be earlier than the third time tSET3*d*.

Specifically, when the gain generator 153 receives the set period pSETd of the second period pSET2*d*, the gain generator 153 may gradually decrease the gain value SSG from the set time tSET2*d* later than the set time tSETd1 when the gain generator 153 receives the set period pSETd of the first period pSET1*d*. Also, the gain generator 153 may decrease the gain value SSG down to the second gain value G2LD as the saturation level GSAT of the gain value SSG, which is lower than the first gain value G1Ld. Also, the gain generator 153 may increase the gain value SSG up to the second gain value G2Ld' as the final level GF of the gain value SSG, which is higher than the first gain value G1Ld'.

In addition, when the gain generator 153 receives the set period pSETd of the third period pSET3*d*, the gain generator 153 may gradually decrease the gain value SSG from the set time tSET3*d* later than the set time tSETd2 when the gain generator 153 receives the set period pSETd of the second period pSET2*d*. Also, the gain generator 153 may decrease the gain value SSG down to the third gain value G3LD as the saturation level GSAT of the gain value SSG, which is lower than the second gain value G2Ld. Also, the gain generator 153 may increase the gain value SSG up to the third gain value G3Ld' as the final level GF of the gain value SSG, which is higher than the second gain value G2Ld'.

In accordance with this embodiment, the set time tSET, the saturation level GSAT of the gain value SSG, and the final level GF of the gain value SSG may be set high. The effect of afterimage prevention and power consumption reduction may be maximized as the set time tSET becomes earlier. Further, a clearer image may be displayed to a user as the gain value SSG is set higher.

Figure 11:
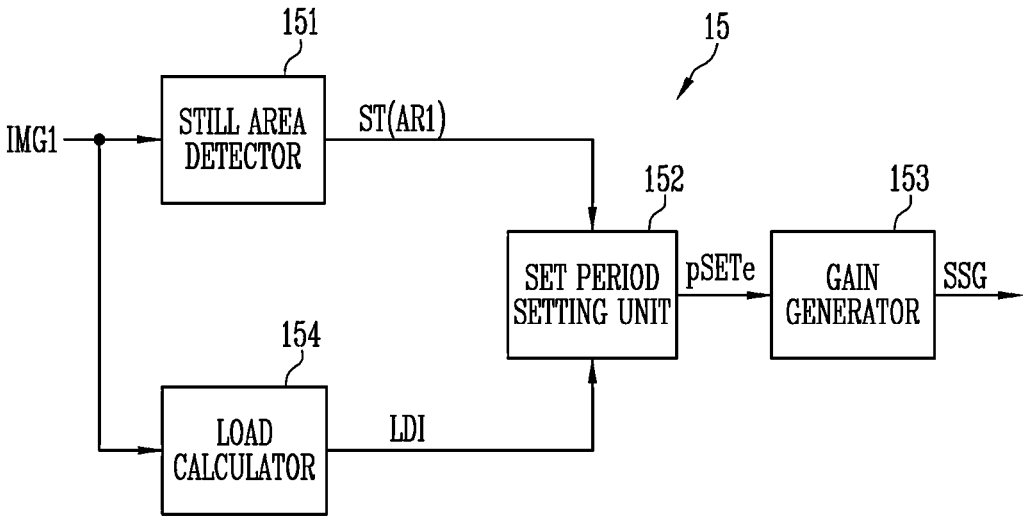
FIG. 11 is a diagram illustrating an embodiment of a gain provider including a still area detector and a load calculator in accordance with the invention.

FIG. 11 is a diagram illustrating an embodiment of a gain provider including a still area detector and a load calculator in accordance with the invention.

Referring to FIG. 11, the gain provider 15 in accordance with still another embodiment of the invention may include a still area detector 151, a set period setting unit 152, a gain generator 153, and a load calculator 154. Therefore, descriptions of portions overlapping with those of the above-described embodiments will be omitted.

The set period setting unit 152 may set a set period pSETe, based on grayscale values ST(AR1) and a load value LDI.

In the display device and the driving method thereof in accordance with the invention, a time at which the display device enters into a screen saver may be changed by a histogram and a load value of an input image.

In the display device and the driving method thereof in accordance with the invention, a gain value of a screensaver may be changed by a histogram and a load value of an input image.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention.

What is claimed is:

1. A display device comprising:

a set period setting unit which sets, as a set time, a time for which a set period elapses from a time at which a first area included in an input image is detected as a still area; and a gain generator which gradually decreases an initial level of a gain value down to a saturation level having a lowest value of the gain value from the set time, wherein the set period setting unit differently sets the saturation level of the gain value and a final level of the gain value, corresponding to grayscale values of the first area and a load value of the input image, wherein the load value is an average value of grayscale values of an entirety of an area of the input image, and wherein the final level is the gain value corresponding to a time at which it is detected that the first area is not the still area.

2. The display device of claim 1, wherein the gain generator increases the gain value up to the final level, after a predetermined period elapses from a time at which the gain value reaches the saturation level, and wherein the predetermined period is from the set time to the time at which it is detected that the first area is not the still area.

3. The display device of claim 2, wherein the set period setting unit:

calculates histogram values of pixels constituting the first area by the grayscale values of the first area; and calculates the histogram value of a pixel having a largest grayscale value among the pixels.

4. The display device of claim 3, wherein the set period setting unit:

sets the set period to become shorter as the histogram value becomes larger; and sets the set period to become longer as the histogram value becomes smaller.

5. The display device of claim 4, wherein the gain generator:

sets the final level of the gain value to become smaller as the histogram value becomes larger; and sets the final level of the gain value to become larger as the histogram value becomes smaller.

6. The display device of claim 5, wherein the gain generator:

sets the saturation level of the gain value to become larger as the histogram value becomes larger; and sets the saturation level of the gain value to become smaller as the histogram value becomes smaller.

7. The display device of claim 6, wherein the set period setting unit:

sets the set period to become longer as the load value of the input image becomes larger; and sets the set period to become shorter as the load value of the input image becomes smaller.

8. The display device of claim 7, wherein the gain generator:

sets the final level of the gain value to become larger as the load value becomes larger; and sets the final level of the gain value to become smaller as the load value becomes smaller.

9. The display device of claim 8, wherein the gain generator:

sets the saturation level of the gain value to become smaller as the load value becomes larger; and sets the saturation level of the gain value to become larger as the load value becomes smaller.

10. The display device of claim 9, further comprising:

a still area detector which detects the first area of the input image as the still area, and provide the grayscale values of the first area; and a load calculator which calculates, as the load value, an average value of the grayscale values of the entirety of the area of the input image.

11. A method for driving a display device including a set period setting unit and a gain generator, the method comprising:

setting, by the set period setting unit, as a set time, a time for which a set period elapses from a time at which a first area included in an input image is detected as a still area; and gradually decreasing, by the gain generator, an initial level of a gain value down to a saturation level having a lowest value of the gain value from the set time, wherein the set period setting unit differently set the saturation level of the gain value and a final level of the gain value, corresponding to grayscale values of the first area and a load value of the input image, wherein the load value is an average value of grayscale values of an entirety of an area of the input image, and wherein the final level is the gain value corresponding to a time at which it is detected that the first area is not the still area.

12. The method of claim 11, wherein the gradually decreasing the initial level of the gain value down to the saturation level of the gain value includes increasing, by the gain generator, the gain value up to the final level, after a predetermined period elapses from a time at which the gain value reaches the saturation level, and wherein the predetermined period is from the set time to the time at which it is detected that the first area is not the still area.

13. The method of claim 12, wherein the setting, as the set time, the time for which the set period elapses from the time at which the first area included in the input image is detected as the still area includes:

calculating, by the set period setting unit, histogram values of pixels constituting the first area by the grayscale values of the first area; and calculating, by the set period setting unit, the histogram value of a pixel having a largest grayscale value among the pixels.

14. The method of claim 13, wherein the setting, as the set time, the time for which the set period elapses from the time at which the first area included in the input image is detected as the still area includes:

setting, by the set period setting unit, the set period to become shorter as the histogram value becomes larger; and setting, by the set period setting unit, the set period to become longer as the histogram value becomes smaller.

15. The method of claim 14, wherein the gradually decreasing the initial level of the gain value down to the saturation level of the gain value includes:

setting, by the gain generator, the final level of the gain value to become smaller as the histogram value becomes larger; and setting, by the gain generator, the final level of the gain value to become larger as the histogram value becomes smaller.

16. The method of claim 15, wherein the gradually decreasing the initial level of the gain value down to the saturation level of the gain value includes:

setting, by the gain generator, the saturation level of the gain value to become larger as the histogram value becomes larger; and setting, by the gain generator, the saturation level of the gain value to become smaller as the histogram value becomes smaller.

17. The method of claim 16, wherein the setting, as the set time, the time for which the set period elapses from the time at which the first area included in the input image is detected as the still area includes:

setting, by the set period setting unit, the set period to become longer as the load value of the input image becomes larger; and setting, by the set period setting unit, the set period to become shorter as the load value of the input image becomes smaller.

18. The method of claim 17, wherein the gradually decreasing the initial level of the gain value down to the saturation level of the gain value includes:

setting, by the gain generator, the final level of the gain value to become larger as the load value becomes larger; and setting, by the gain generator, the final level of the gain value to become smaller as the load value becomes smaller.

19. The method of claim 18, wherein the gradually decreasing the initial level of the gain value down to the saturation level of the gain value includes:

setting, by the gain generator, a middle level of the gain value to become smaller as the load value becomes larger; and setting, by the gain generator, the middle level of the gain value to become larger as the load value becomes smaller.

20. The method of claim 19, wherein the display device further includes a still area detector and a load calculator, and wherein the method further comprises:

detecting, by the still area detector, the first area of the input image as the still area, and providing the grayscale values of the first area; and calculating, the load calculator, as the load value, an average value of the grayscale values of the entirety of the area of the input image.

* * * * *